US006230931B1

(12) United States Patent
Mandle et al.

(10) Patent No.: US 6,230,931 B1
(45) Date of Patent: May 15, 2001

(54) DISPENSING PACKAGE

(75) Inventors: James S. Mandle, Woodcliff Lake; Charles F. Flynn, Oak Ridge, both of NJ (US); Jerry Zinnbauer, Cornelius; Johnny W. Jarrells, Asheboro, both of NC (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/363,899

(22) Filed: Jul. 30, 1999

(51) Int. Cl.[7] ..... B65G 59/00; B65H 3/00; G07F 11/16

(52) U.S. Cl. ..... 221/247; 221/226; 221/227; 221/270

(58) Field of Search ..... 221/224, 226, 221/227, 229, 247, 250, 266, 270, 271, 275, 281

(56) References Cited

U.S. PATENT DOCUMENTS 3,777,931 * 12/1973 Fleming ..... 221/227 X
4,151,931 * 5/1979 Scherer et al. ..... 221/226 X
5,071,033 * 12/1991 Siwek ..... 221/229 X
5,253,784 * 10/1993 Kossel ..... 221/281 X
5,536,472 * 7/1996 Terashima et al. ..... 221/226 X
6,070,759 * 6/2000 Bridge et al. ..... 221/200 X

* cited by examiner

*Primary Examiner*—Christopher P. Ellis
*Assistant Examiner*—Gene O. Crawford
(74) *Attorney, Agent, or Firm*—Darryl C. Little; Evan J. Federman

(57) ABSTRACT

A dispensing package for substantially flat items, such as razor blades, gum and mints. The dispensing package contains a hollow container having a slot on one side and a dispensing door on one end adjacent to the slot. An elevator is located within the track for supporting and lifting the confectionery items. An elevator button is located on one end of the elevator and protrudes through the slot to allow the user to manually raise the elevator and the items located thereon. On the inside of the package and adjacent to the slot is a ratcheting track which corresponds with ratcheting protrusions on the elevator button. The ratcheting track and ratcheting protrusions allow the elevator to move upward in a manner such that only one item at a time is dispensed. Upon the exertion of manual force to lift the elevator button in an upward direction, the elevator is raised via the ratcheting track and protrusions and the top item contacts and pushes open the dispensing door. The product to be used is then removed through the dispensing door.

9 Claims, 9 Drawing Sheets

DISPENSING PACKAGE

FIELD OF THE INVENTION

The present invention is directed to a dispensing package for similarly shaped items such as chewing gum, mints, razor blades or the like.

BACKGROUND OF THE INVENTION

Confectionery products, such as chewing gum, mints and the like, have been dispensed from many different types of containers for many years. For example, both stick and slab chewing gum have been dispensed from packages which have had a portion of the package removed or opened to expose the individual pieces of gum. Likewise, mints have been dispensed from packages which contain openings through which the mints are funneled outward. It would be advantageous to provide a dispensing package for confectionery products, such as chewing gum and mints, which would position a desired serving, i.e., one mint or one piece of gum, such that it could be easily removed by the consumer while using only one hand. At the same time, it would be advantageous for the dispensing package to provide the user with a means for moving the desired item into a position where it could be easily removed while retaining the remainder of the items safely within the package.

SUMMARY OF THE INVENTION

The present invention discloses a dispensing package for confectionery items, such as gum and mints. The dispensing package contains a hollow container having a slot on one side and a dispensing door on one end adjacent to the slot. An elevator is located within the track for supporting and lifting the confectionery items. An elevator button is located on one end of the elevator and protrudes through the slot to allow the user to manually raise the elevator and the items located thereon. On the inside of the package and adjacent to the slot is a ratcheting track which corresponds with ratcheting protrusions on the elevator button. The ratcheting track and ratcheting protrusions allow the elevator to move upward in a manner such that only one item at a time is dispensed. Upon the exertion of manual force to lift the elevator button in an upward direction, the elevator is raised via the ratcheting track and protrusions and the top item contacts and pushes open the dispensing door. The product to be used is then removed through the dispensing door.

DETAILED DESCRIPTION OF THE PREFERRED EMBODIMENTS

Figure 1:
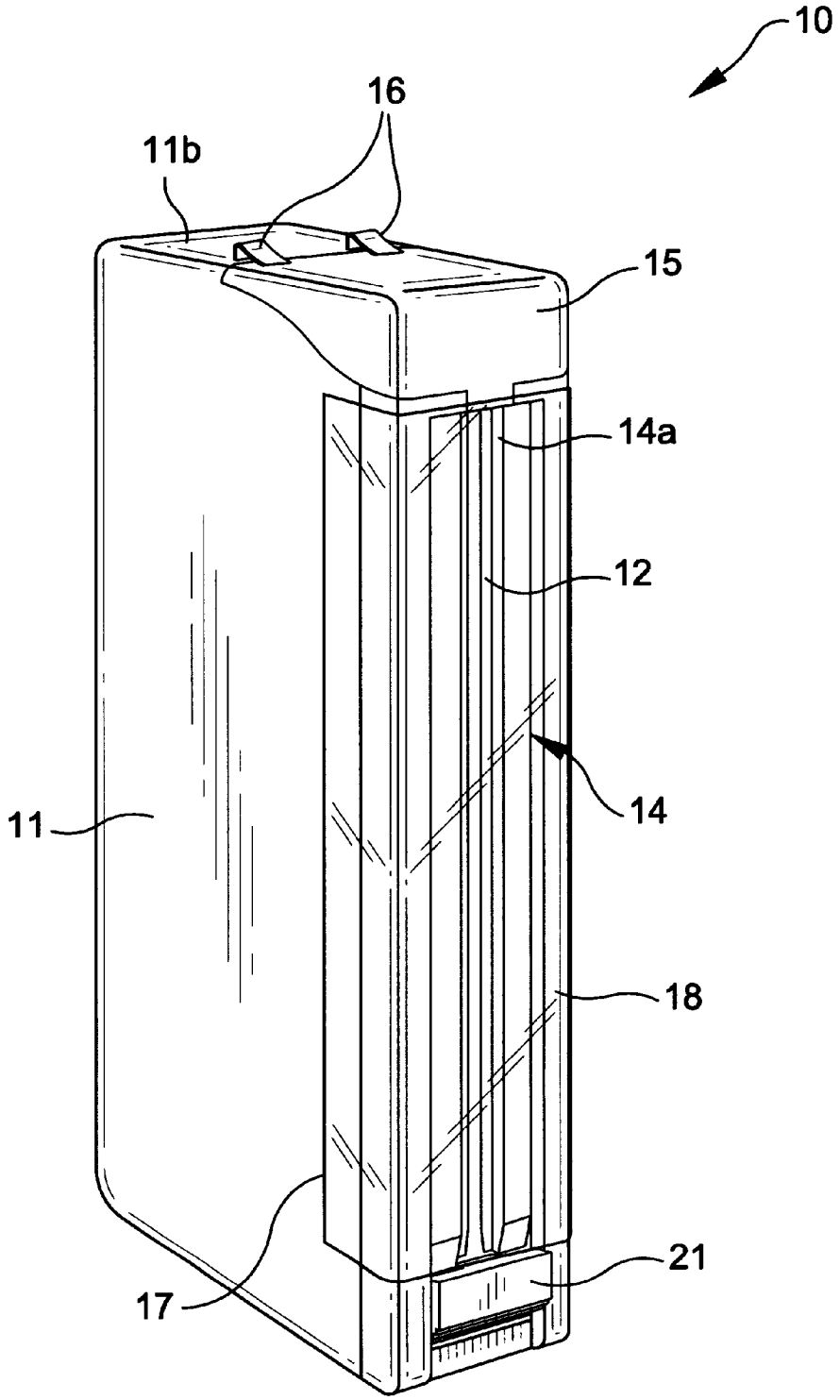
FIG. 1 is a perspective view of the dispensing package.
Figure 2:
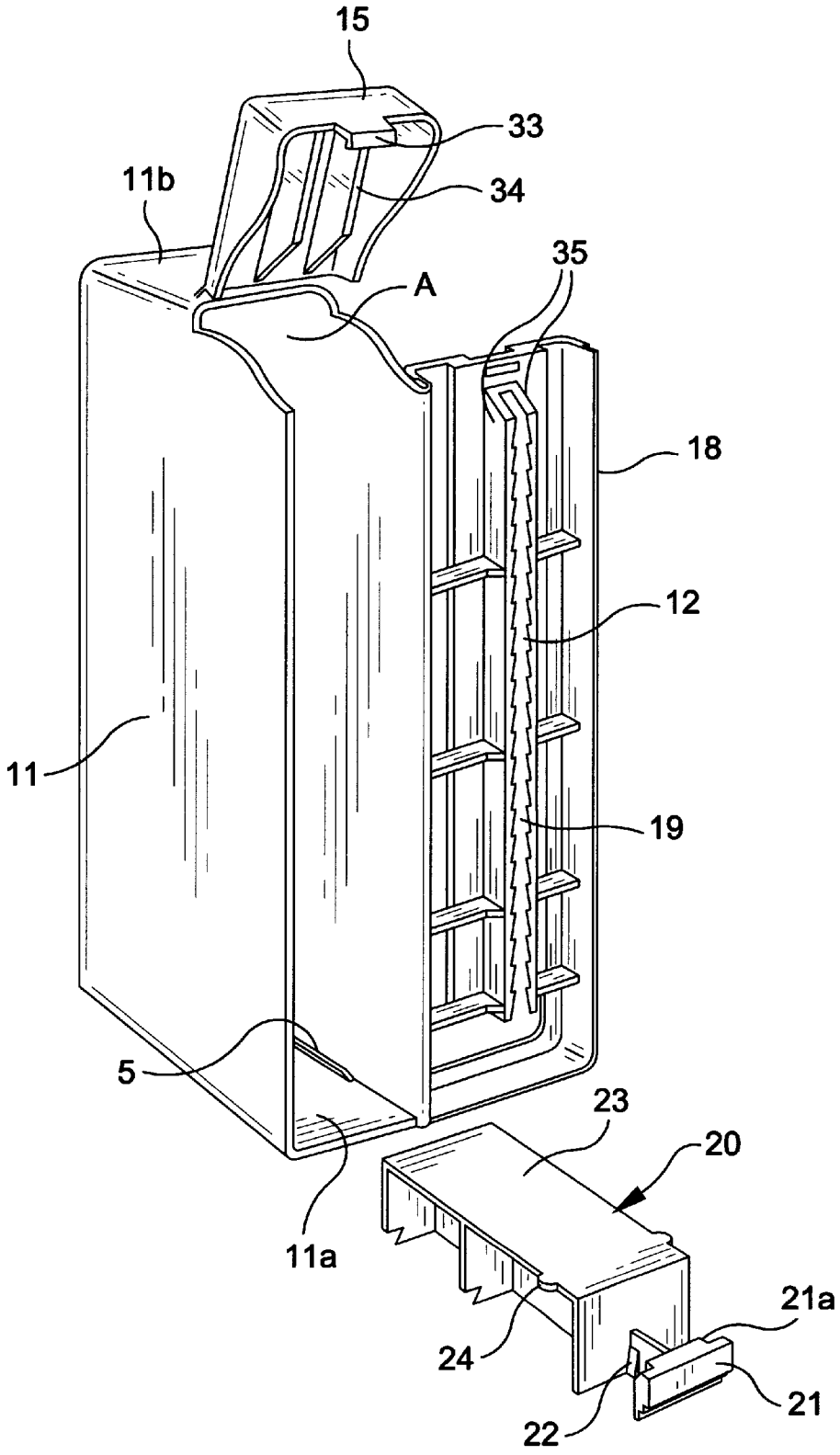
FIG. 2 is an exploded view of the dispensing package and the elevator.
Figure 3:
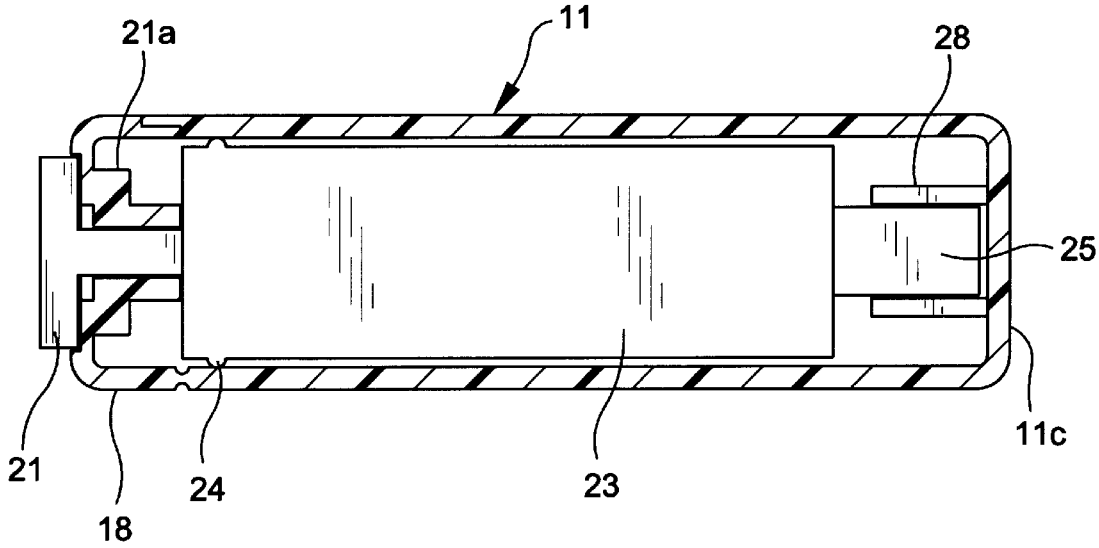
FIG. 3 is a cut-away view of the top of the dispensing package and elevator.
Figure 4:
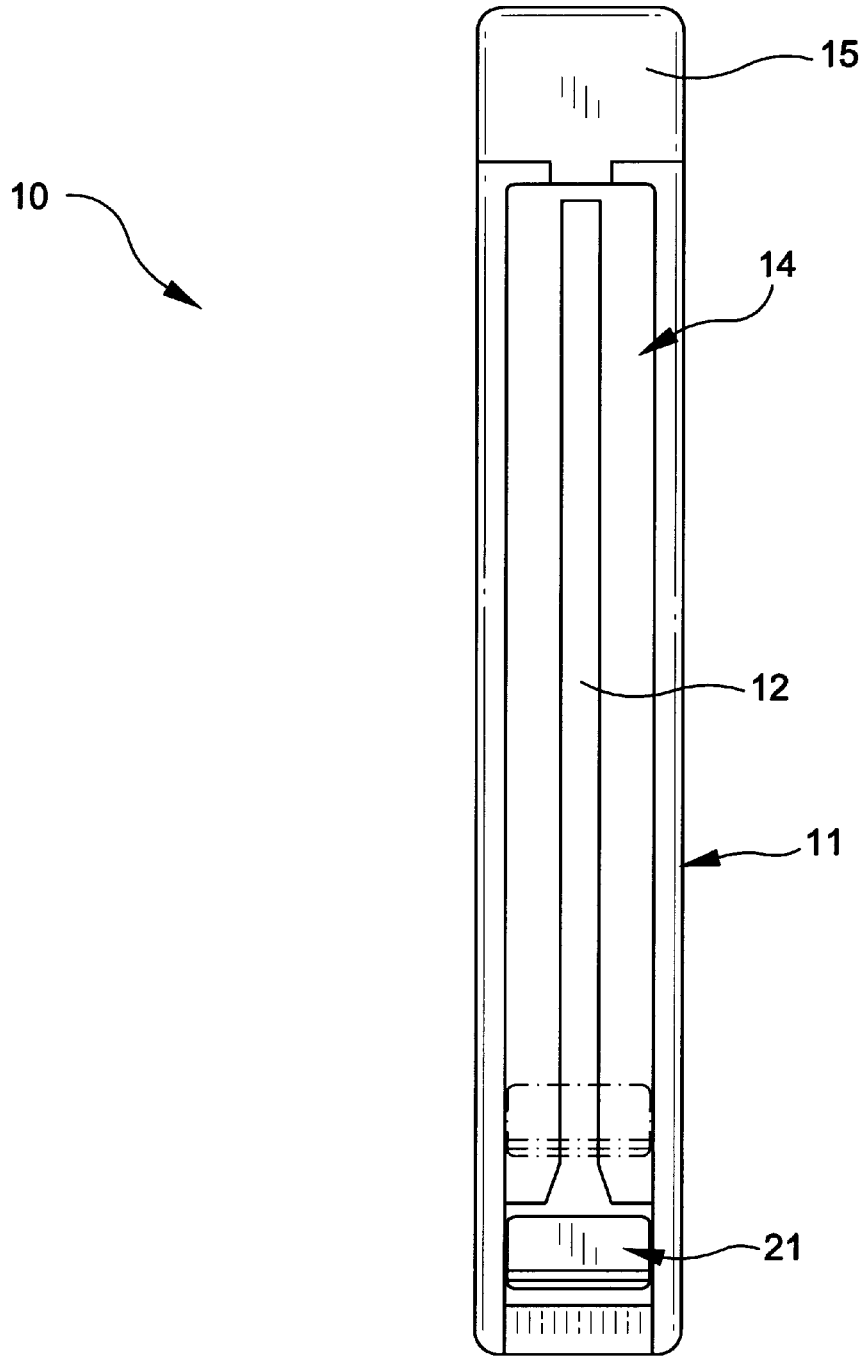
FIG. 4 is a side view of the dispensing package.

FIGS. 1–4 illustrate the dispensing package of the present invention. Dispensing package 10 comprises a hollow box-like structure consisting of side walls 11, floor 11*a*, top 11*b*, back wall 11*c*, front wall 18 and dispensing door 15. Dispensing door 15 is connected to the top 11*b* of the dispensing package 10 via living hinges 16 and preferably contains snap 33 to fasten the dispensing door to front wall 18 when the package is in the closed position. When the dispensing door is in the open position, dispensing opening A allows for removal of product from the package. In the preferred embodiment, one or more ribs 34 are located on the underside of dispensing door 15. Front wall 18 preferably contains a first indented portion 14 and a second, further indented portion 14*a*. Slot 12 is located substantially in the middle of the front wall, and preferably in the middle of second indented portion 14*a*. Slot 12 extends longitudinally from a point near the top of the front wall and adjacent to snap 33 to a point near the bottom of the front wall. On the inside of the front wall are two inwardly projecting walls 35. Each wall contains a ratcheting track 19 having steps angled in an upward direction. An additional set of inner walls 28 preferably extends inward from the back wall 11*c* of the package opposite the slot and ratcheting track. Inner walls 28 may have widened portion 28*a* at their base. In an especially preferred embodiment, winged ribs 5 extend upward from the floor 11*a* of the package, at an angle away from each side wall and perpendicular to the front wall.

In an especially preferred embodiment, label 17 may be placed over the front wall 18 such that the label covers the slot 12 and preferably is affixed to side walls 11. The label may be of any desired transparency and, if desired, may contain printed instructions, advertising, etc. The label extends across slot 12 and prevents the upward movement of the elevator button when the label is in place. The label performs several functions. One label function is to prevent tampering with the package. In the event that the label is missing or broken, the user will be able to determine that the product may have been tampered with. A second function of the label is to create a seal over the slot so that the product remains fresh. Also in an alternative embodiment, the front wall 18 may have a horizontal slot (not illustrated) which would allow for insertion of the elevator through door 18 after product has been loaded.

Figure 8:
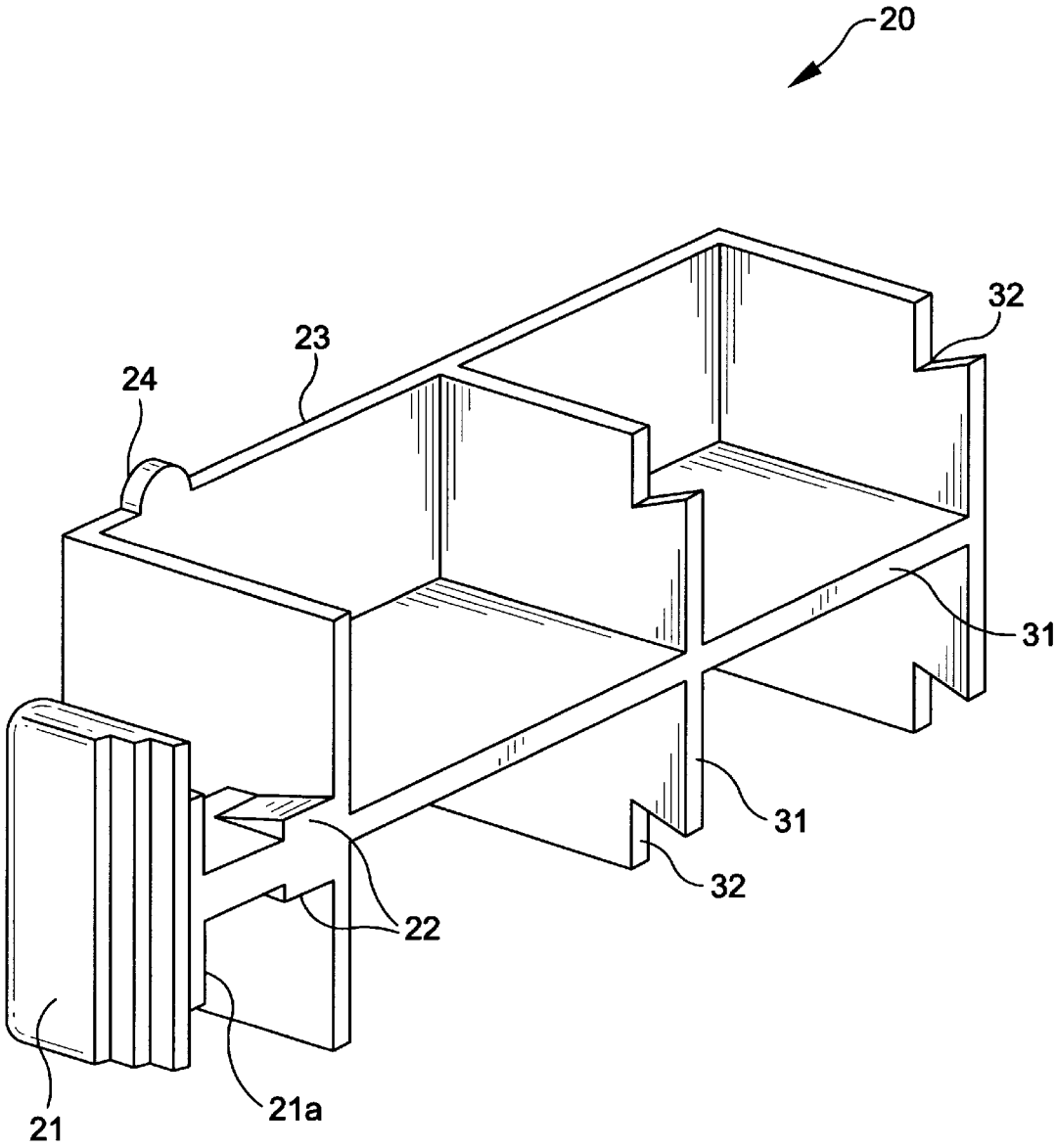
FIG. 8 is a perspective view of the elevator and elevator button.
Figure 9:
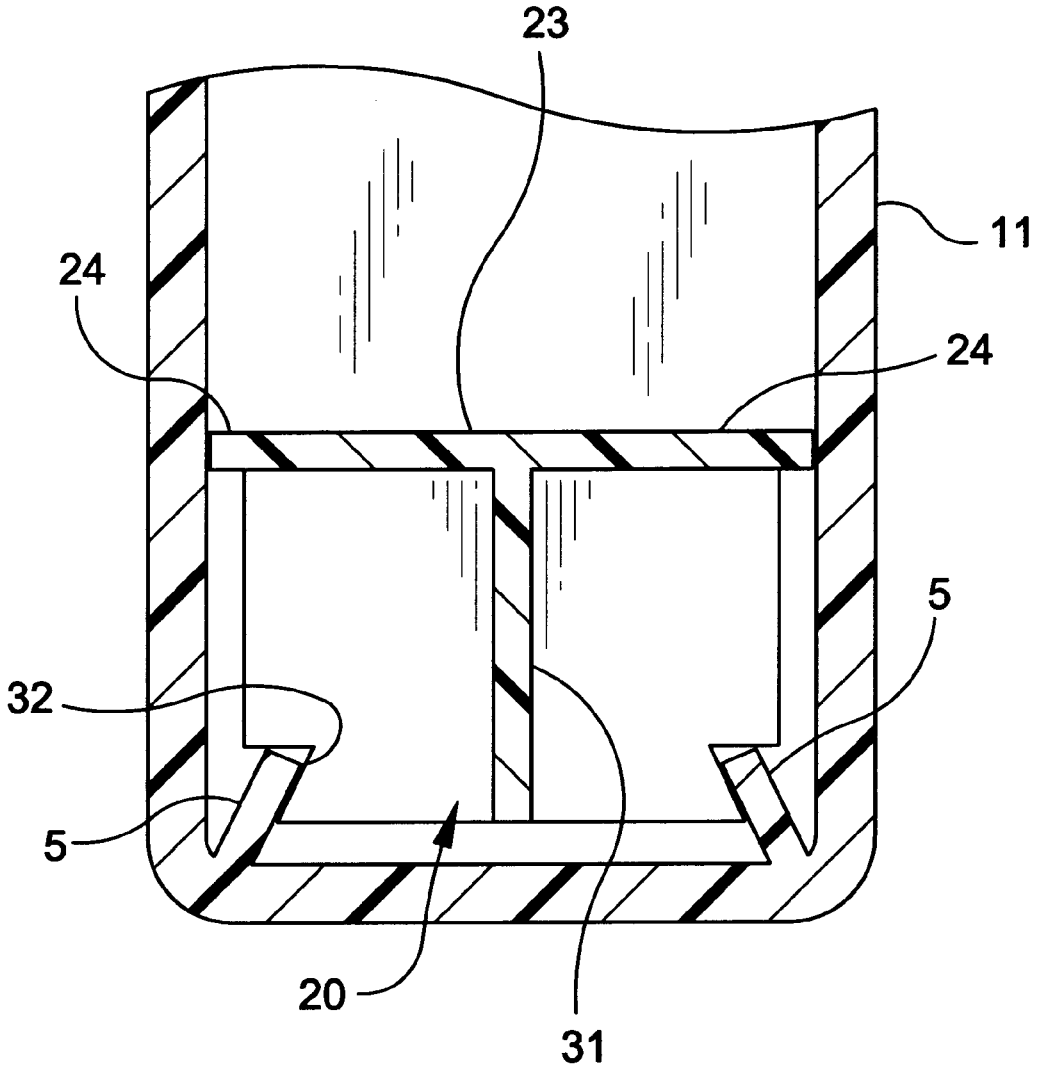
FIG. 9 is a cut-away view of the bottom of the dispensing package.

The dispensing package of the present invention further comprises an elevator member 20. The elevator member, further illustrated in FIG. 8, comprises a substantially flat top surface 23, an elevator button 21 and ratcheting protrusions 22. In the preferred embodiment the ratcheting protrusions are angled downward and the back of the elevator button comprises widened portion 21*a*. Tabs 24 extend outward from top surface 23 in order to position the front portion of the elevator in a manner which is substantially parallel to the package. Likewise, extension 25 protrudes from the back of the top surface 23 and aligns within inner walls 28 of the dispensing package. The extension, along with the shape of the top surface which preferably conforms to the inside shape of the package, act to prohibit the elevator from lateral movement when force is applied to the elevator button. Widened portion 28*a* of inner portion 28 acts as a stopper to prevent unwanted movement when the elevator is inserted within the package. Further, widened portion 28*a* acts as guide during the initial upward movement of the elevator. In the preferred embodiment illustrated in FIG. 8, ribs 31 extend outward from the underside of the elevator. Notches 32 are located on the bottom corner of the ribs. Further, in a fully loaded position the notches 32 are preferably aligned with the winged ribs 5 on the floor 11*a* of the package. This alignment locks the elevator at the bottom of the package and prevents undesired upward movement during manufacture, shipping, filling, storage, etc. Further, the connection between the notches 32 and winged ribs 5 prevents lateral movement of the elevator and also acts to hold the elevator in position while the package is being loaded with product.

Figure 5:
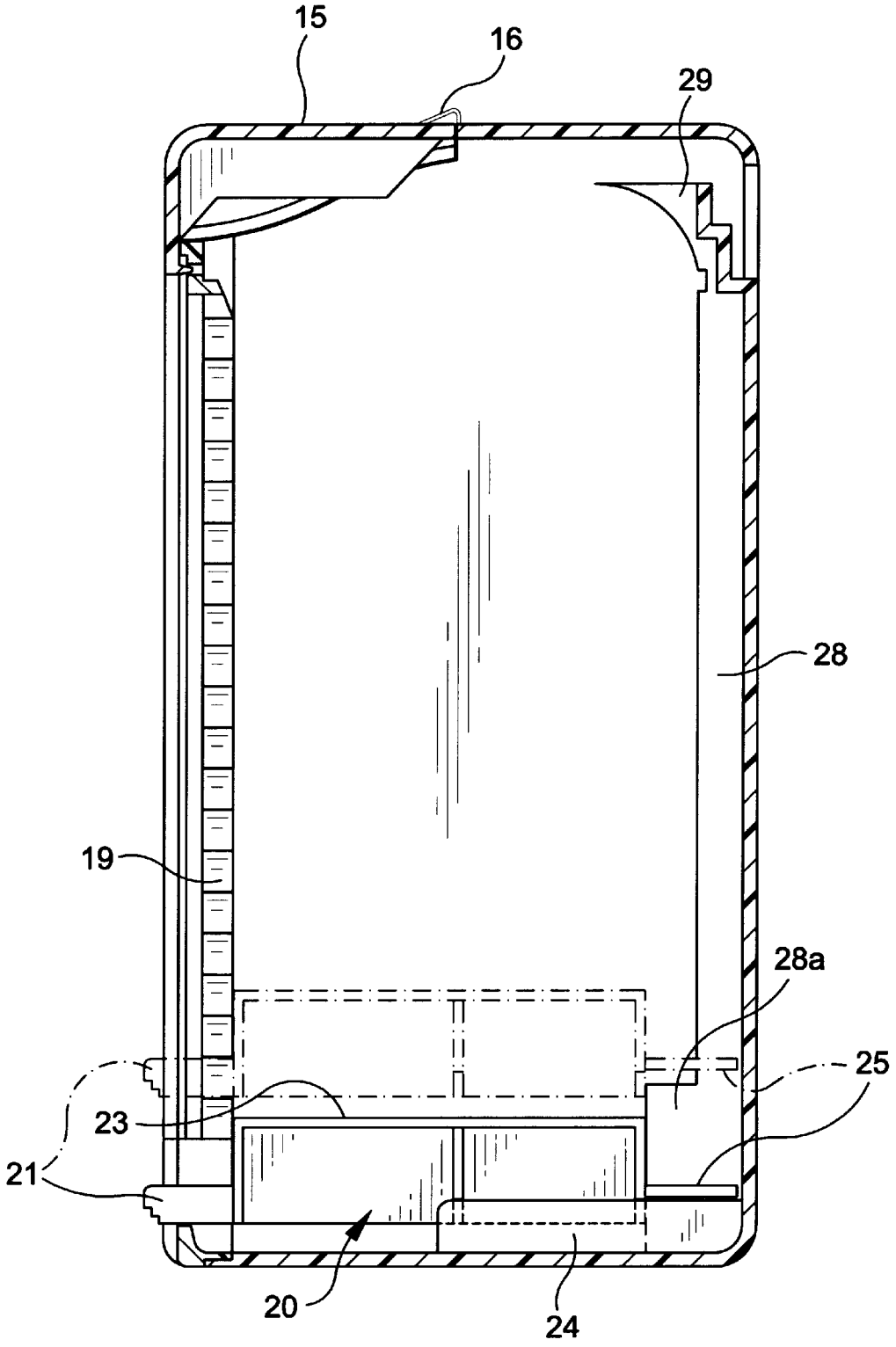
FIG. 5 is a cut-away side view of an empty dispensing package.
Figure 6:
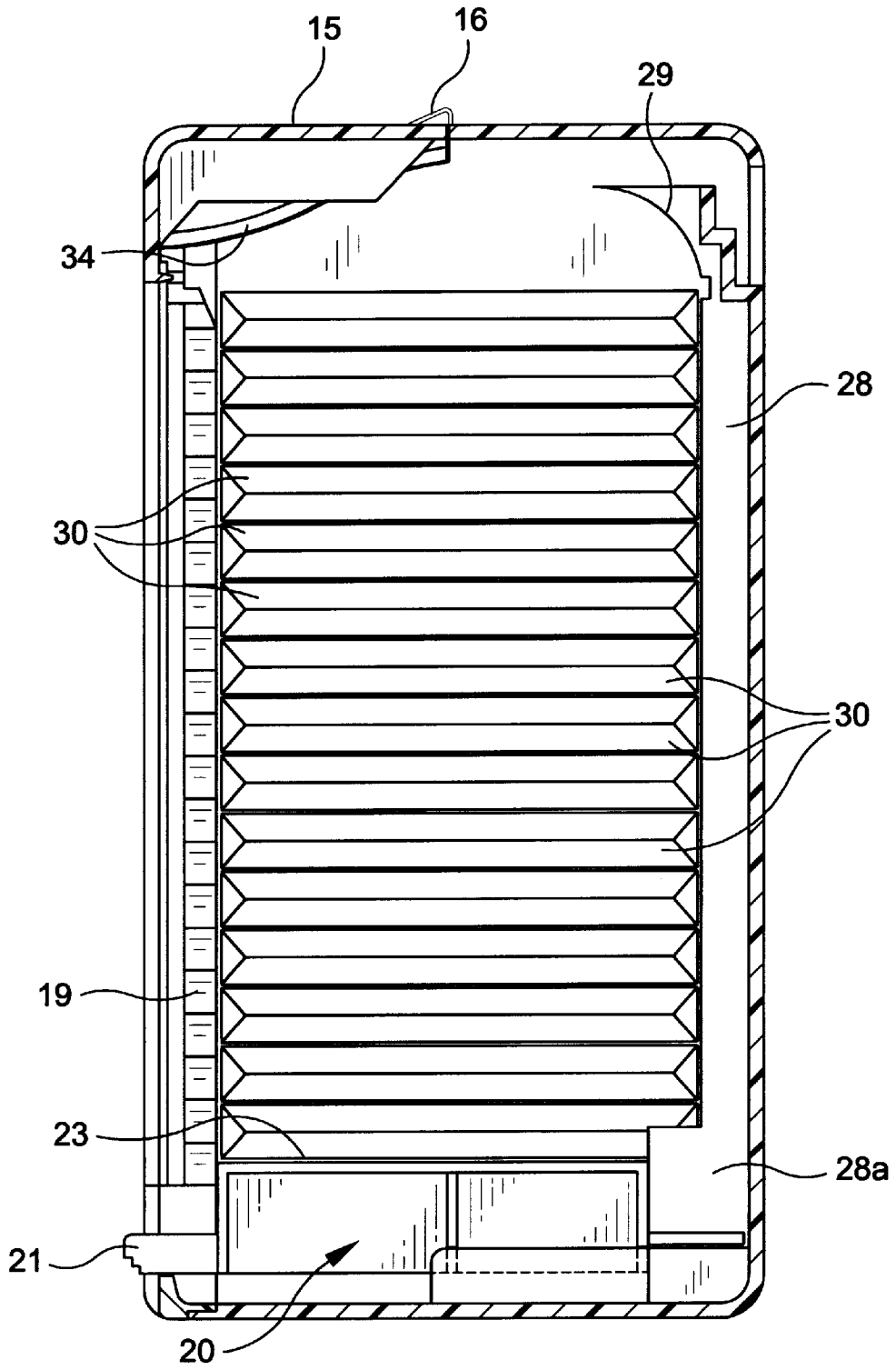
FIG. 6 is a cut-away side view of a dispensing package containing product.
Figure 7:
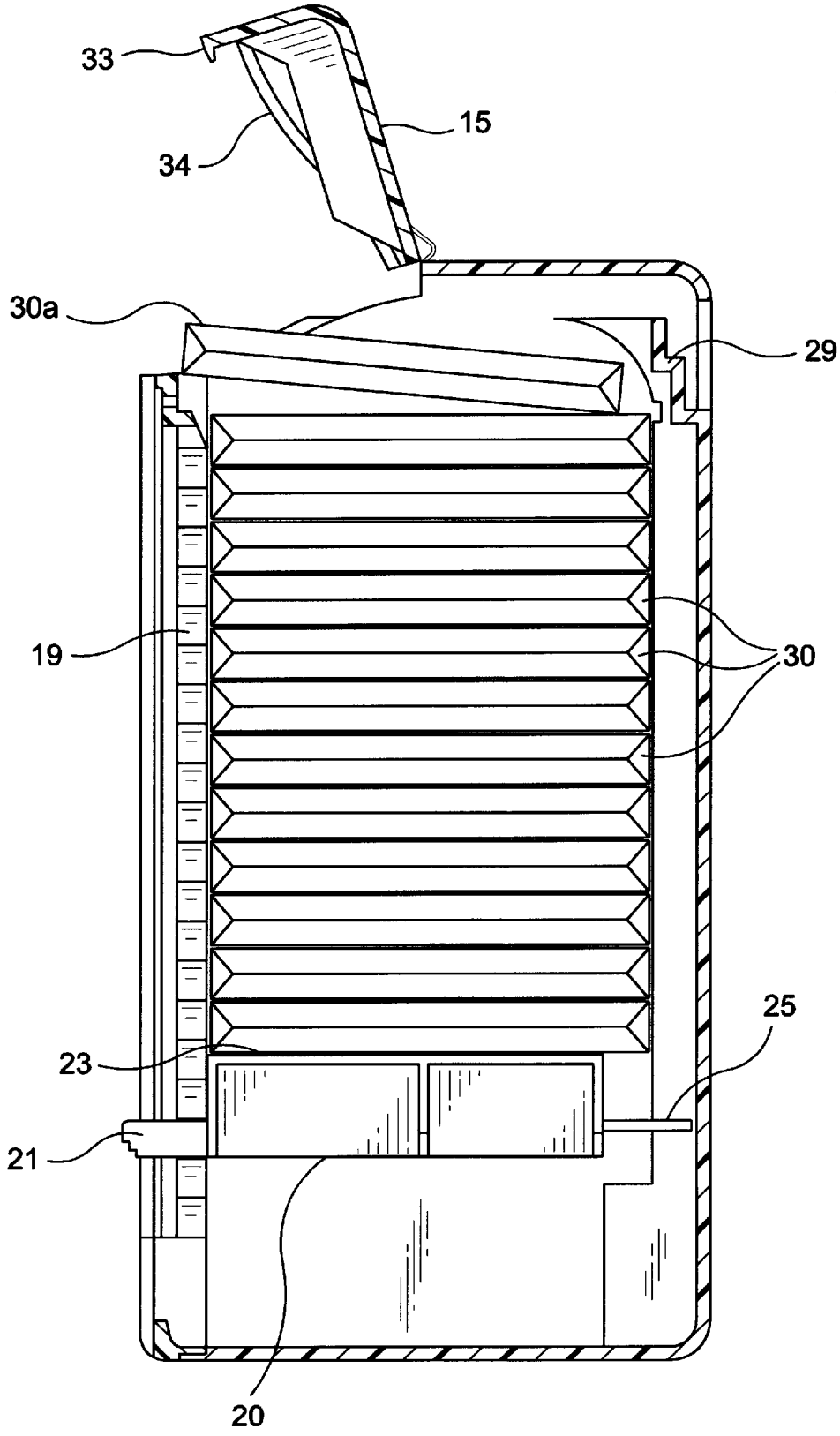
FIG. 7 is a cut-away side view of a dispensing package with a product in position to be removed.

As illustrated in FIGS. 5–7, the dispensing package 10 comprises a substantially hollow box which may be filled with a product such as a confectionery product which is to be dispensed. Also, while a rectangular package is illustrated the package could comprise any desired shape. For example, FIGS. 6 and 7 illustrated the dispensing package filled with rectangular slabs of chewing gum 30. However, any desired product of any desired shape, although flat items are preferable, could be contained within the package. Initially, when the package is full, the elevator 20 rests adjacent to the floor of the package and the product to be dispensed rests upon the top surface 23 of the elevator. The elevator's actual proximity to the floor of the package is dependent upon the desired amount of filling of the package. For example, if the package is to be less than entirely full, the elevator would initially be located in a position above the floor of the package so as to contact the bottom piece of a stack of product. In order to obtain a piece of product for use, the consumer pushes the elevator button 21 upward. The upward force causes the ratcheting protrusions to move upward within the ratcheting track and the elevator to move upward as indicated in phantom in FIGS. 4 and 5. The downward angling of the ratcheting protrusions, in combination with the upward angling of the ratcheting surface of the ratcheting track, cause the elevator to move only one step at a time. Further, the angling prevents the elevator from moving back down once it has been pushed up. The interaction between the ratcheting protrusions and the ratcheting track will produce an audible and tactile signal to notify the user that the button has been moved.

In the preferred embodiment, the size of the ratchet steps is approximately the same as the size of the product to be contained within the package. This arrangement will allow for the dispensing of one product for each step upward. As the elevator moves upward, the top item 30*a* to be dispensed comes into contact with inner ribs 34 of the dispensing door 15. This contact causes snap 33 to disengage and the dispensing door to open. The door is manually recloseable and remains attached to the top 11*b* of the package via living hinges 16. In the preferred embodiment, spring ramp 29 causes the piece of product 30*a* to be pushed forward and into the opening created by the opening of the dispensing door so that the product may be easily removed by the consumer. The remainder of the products within the package each move upward one step. The movement is further aided by the widened portion 21*a* which moves within the second indented portion 14*a,* and elevator button 21 which moves within the first indented portion 14. The indented portions also act to protect the elevator button from inadvertent forces which may cause unintended movement and to allow the smooth and even application of a label across the front wall.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

We claim:

1. A dispensing package for uniformly shaped products in the form of stacked pieces of product having at least a top piece and a bottom piece, the package comprising:

a.) sidewalls;

b.) a front wall having a longitudinal slot and a corresponding ratcheting track;

c.) a top;

d.) a floor;

e.) a dispensing door connected to the top and capable of moving from an open position to a closed position, the dispensing door having a snap to hold the dispensing door in the closed position;

f.) a back wall containing a spring ramp which extends from the back wall in the direction of the front wall of the dispensing package to push the top piece of the stack of products toward the dispensing door; and g.) an elevator containing an elevator button and a ratcheting protrusion such that the elevator button extends outward from the package through the slot and the ratcheting protrusion aligns with the ratcheting track to permit longitudinal movement of the elevator.

2. A dispensing package according to claim 1 further comprising a label which extends across the slot.

3. A dispensing package according to claim 1, wherein the elevator has a substantially flat top surface.

4. A dispensing package according to claim 3, wherein the back wall of the dispensing package contains two inner walls which extend inward from the back wall and the elevator contains an extension member which fits between the inner walls to prevent lateral movement of the elevator.

5. A dispensing package according to claim 3, wherein the elevator comprises a protrusion to prevent lateral movement of the elevator.

6. A dispensing package according to claim 5, wherein the ratcheting protrusion and the ratcheting track are aligned so as to prevent downward movement of the elevator.

7. A dispensing package according to claim 3, wherein the dispensing door is connected to the top of the dispensing package by one or more living hinges.

8. A dispensing package according to claim 7, wherein the front wall contains a first indented portion.

9. A dispensing package according to claim 8, wherein the front wall contains a second indented portion.

* * * * *